US006237616B1

(12) United States Patent
You

(10) Patent No.: US 6,237,616 B1
(45) Date of Patent: May 29, 2001

(54) WINDPROOF UMBRELLA

(76) Inventor: Ching-Chuan You, c/o Percy International Patent Corp. P.O. Box 1-79, Taipei (TW)

( * ) Notice: Subject to any disclaimer, the term of this patent is extended or adjusted under 35 U.S.C. 154(b) by 0 days.

(21) Appl. No.: 09/332,042

(22) Filed: Jun. 14, 1999

(51) Int. Cl.[7] ..... A45B 25/22
(52) U.S. Cl. ..... 135/33.7; 135/33.5
(58) Field of Search ..... 135/33.5, 33.7

(56) References Cited

U.S. PATENT DOCUMENTS 312,446 * 2/1885 Drake ..... 135/33.7 X
3,885,582 * 5/1975 Kowalski ..... 135/33.7
4,084,600 * 4/1978 DePolo ..... 135/33.5 X
5,078,166 * 1/1992 Lee ..... 135/33.7
5,115,827 * 5/1992 Lee ..... 135/33.7
5,611,364 * 3/1997 Woods et al. ..... 135/33.5 X
6,089,244 * 7/2000 Ko ..... 135/33.7

* cited by examiner

*Primary Examiner*—Christopher T. Kent

(57) ABSTRACT

A windproof umbrella comprises a main umbrella including a plurality of ribs, a lower canopy having a plurality of substantially trapezoidal sectors, and a center vent hole; and an upper umbrella including a plurality of rigid ribs, and an upper canopy having a plurality of sectors, wherein each rib of the upper umbrella is integral with each rib of the main umbrella by means of a connection of a securing device for forming a gap between a corner of two adjacent sectors of the upper canopy and a corner of two corresponding adjacent sectors of the lower canopy, and the upper canopy is in covering relation to and capable of elastically separating from the main umbrella for exhausting the air from the space between the lower canopy and the upper canopy.

1 Claim, 8 Drawing Sheets

WINDPROOF UMBRELLA

BACKGROUND OF THE INVENTION

1. Field of the Invention

The present invention relates to umbrellas, and more particularly to an umbrella that is resistant to inversion from the wind.

2. Description of Related Art

Frequently, a wind will catch an umbrella user unaware and exert a force against the inner surface of the canopy which will cause the canopy to invert from its normal operable position to an upwardly convex position. Accordingly, specially designed umbrellas for rainy, windy weather have been proposed.

As shown in FIGS. 1 and 2, this disclosed windproof umbrella C has an upper canopy C2 in covering relation to a lower canopy C1 in which the canopy C1 has a plurality of (e.g., eight) vent holes H each correspondingly arranged in a sector C3. The upper canopy C2 is disposed over the vent holes H. The area of the upper canopy C2 is about three fifth of the area of the lower canopy C1. In order to secure the bottom edge of the upper canopy C2 to the umbrella C, eight elastic strips E are provided, wherein each of the elastic strips E with one end sewn to a corner of adjacent sectors C4 of the upper canopy C2, and the opposite end fitted tightly onto a tip of a rib G. During rainy, windy weather, wind I that is caught beneath the lower canopy C1 exit through the vent holes H and applies pressure to the underside of the upper canopy C2. This forces the upper canopy C2 lift away from the lower canopy C1 by means of the elastic strips E which are stretched to provide a path for wind I to escape the umbrella C. However, because the elastic strips E often stretched, its elasticity will be worn out after used for a predetermined times. As a result, the escape space for wind I will become larger.

Thus, heavy rain may enter the space between the lower canopy sectors C3 and the upper canopy sectors C4 and fall through bottom edges H1 of the vent holes H in the lower canopy C1 onto the user. Further, the manufacturing process of the windproof umbrella C is time consuming. For example, the upper canopy C2 comprises eight sectors C4. Two edges of each canopy sector C4 are secured to the ribs G by means of stitching respectively. As stated above, the corner of adjacent canopy sectors C4 is sewn to one end of the elastic strip E, and the opposite end of the elastic strip E is fitted tightly onto the tip of the rib G. Furthermore, the lower canopy C1 and the upper canopy C2 (via the stretched elastic strips E) both exert a force onto the tip of the rib G and thus, the elastic strips E are very taut. As a result, the elastic strips E are prone to be separated from the tips of the ribs G in case of the tip of the ribs G damaged. Once the elastic strips E are separated from the tips of the ribs G, upper canopy C2 will be lifted by the upward wind I caught beneath the canopy C1. Thus, the windproof function of the umbrella C will be completely worthless because the bottom edges H1 of the vent holes H are not covered anymore.

An umbrella C which is similar in construction is disclosed in FIGS. 3 and 4. A circular vent hole H is provided in the center portion of a canopy C1. A small circular piece of fabric C2 is positioned over the canopy C1 in covering relation to the vent hole H. The area of the piece of fabric C2 is about two fifth of the area of the canopy C1. Accordingly, an elastic strip E, which attached from a corner of adjacent fabric sectors C3 to a tip G, will have a relatively longer length as compared with the elastic strip E illustrated in FIGS. 1 and 2. Further, because the price of elastic strip is higher than that of fabric, the cost of manufacturing the umbrella shown in FIGS. 3 and 4 will be higher than that of FIGS. 1 and 2 in spite of the saving in fabric. Furthermore, the umbrella of FIGS. 3 and 4 has the same disadvantage as that of FIGS. 1 and 2 in respect of the elastic fatigue of the elastic strips.

Thus, it is desirable to provide a windproof umbrella to overcome the above drawbacks of prior art.

SUMMARY OF THE INVENTION

It is an object of the present invention to provide a windproof umbrella which comprises a main umbrella including a shank, a movable ring being capable of sliding along the shank, a plurality of ribs each having a free end portion, a plurality of spreaders each with one end pivotally secured to the ring and the other end pivotally secured to a predetermined position of one of the ribs, a lower canopy having a plurality of substantially trapezoidal cloth sectors in which a seam between sectors of the lower canopy is stitched from a top to a bottom of each of the ribs along its length to the free end portion thereof, and a substantially polygonal vent hole provided in a center portion of the main umbrella; an upper umbrella including a stationary hub, a plurality of ribs each having a free end portion, and an upper canopy having a plurality of substantially triangular cloth sectors; and a ferrule on a top of the upper umbrella; wherein each of the ribs of the upper umbrella is integral with each of the ribs of the main umbrella by means of a connection of a securing device for forming a gap between a corner of two adjacent sectors of the upper canopy and a corner of two corresponding adjacent sectors of the lower canopy, and the upper canopy is in covering relation to and capable of elastically separating from the main umbrella for exhausting the air from the space between the lower canopy and the upper canopy.

It is another object of the present invention to provide a windproof umbrella which does not employ any elastic strip.

It is a further object of the present invention to provide a durable windproof umbrella by a providing the securing device for connecting the upper umbrella and the main umbrella.

It is still a further object of the present invention to provide a windproof umbrella which is time saving in assembly and cost effective by eliminating the process of stitching the upper canopy to the ribs of the upper umbrella.

The above and other objects, features and advantages of the present invention will become apparent from the following detailed description taken with the accompanying drawings.

DETAILED DESCRIPTION OF THE PREFERRED EMBODIMENTS

Figure 1:
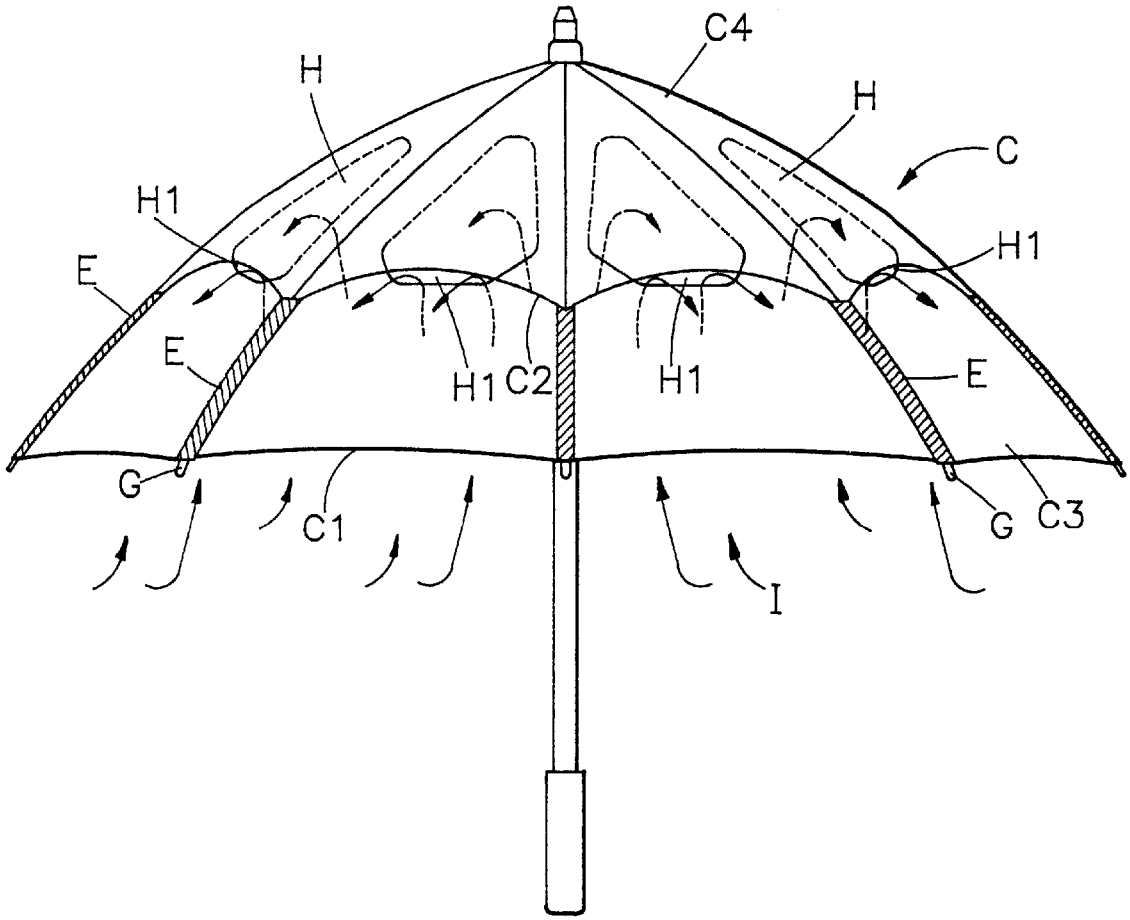
FIG.1(PRIOR ART)
FIG. 1 is a perspective view of a conventional windproof umbrella, in an assembled, open condition.
Figure 2:
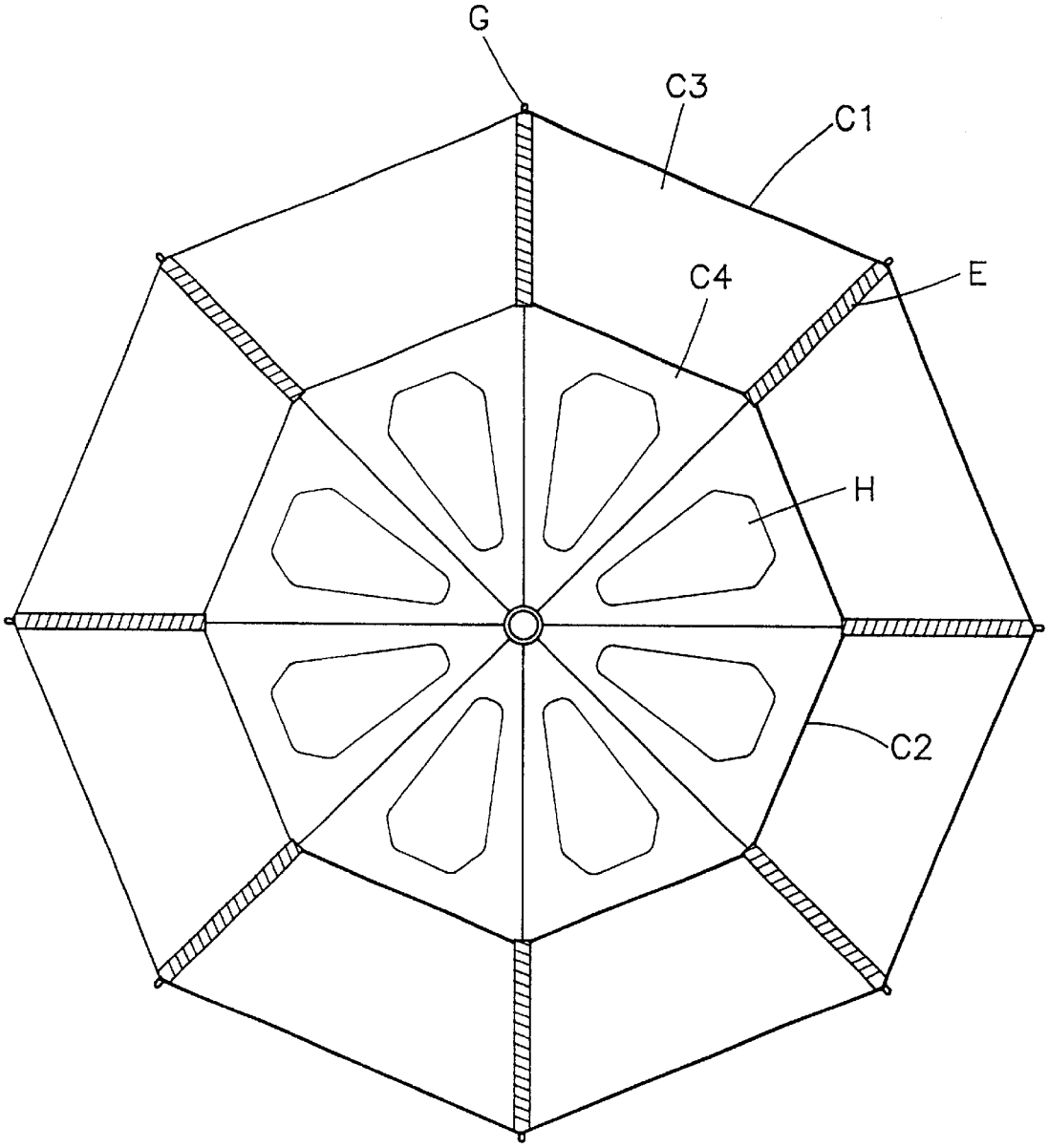
FIG.2(PRIOR ART)
FIG. 2 is a bottom plan view of FIG. 1, in an assembled, open condition.
Figure 3:
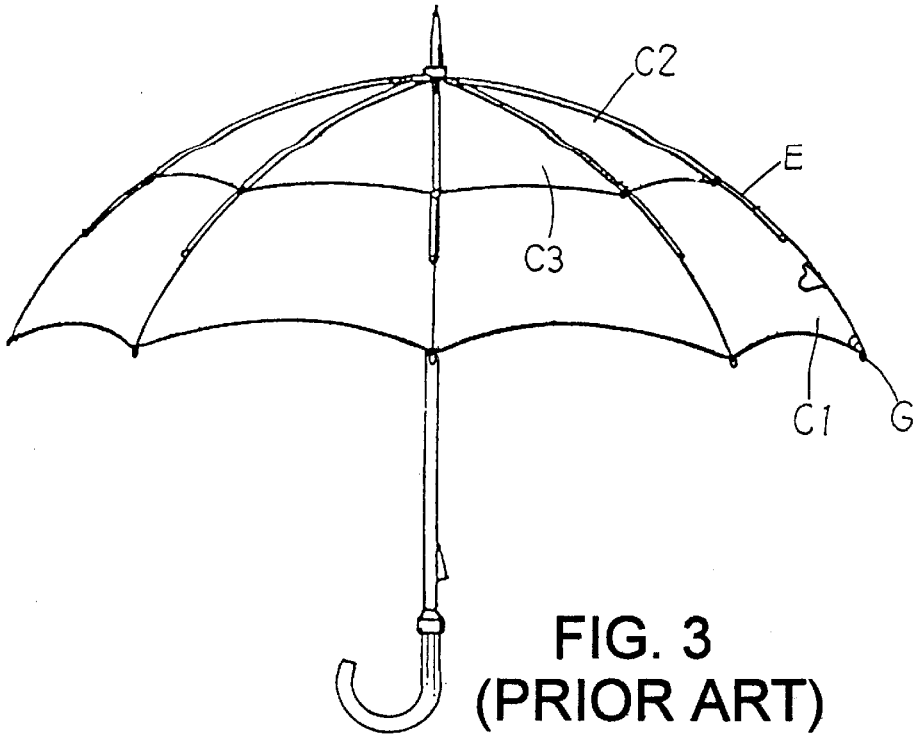
FIG. 3 (PRIOR ART)
FIG. 3 is a perspective view of another conventional windproof umbrella, in an assembled, open condition.
Figure 4:
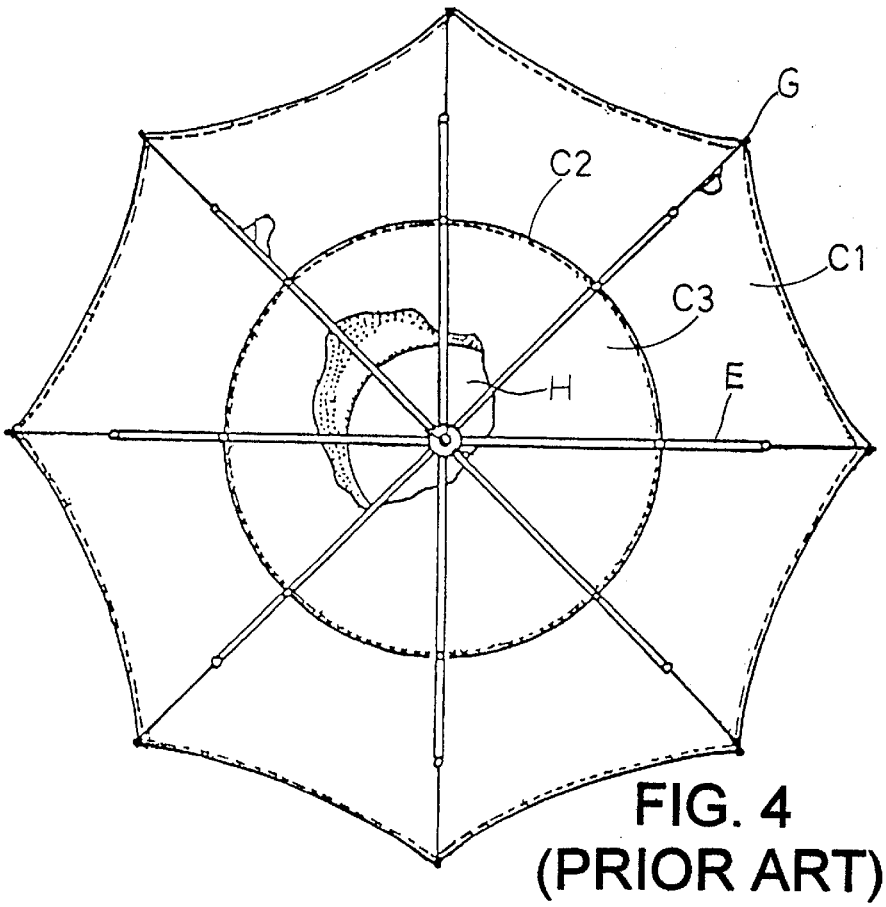
FIG. 4 (PRIOR ART)
FIG. 4 is a bottom plan view of FIG. 3, in an assembled, open condition.
Figure 5:
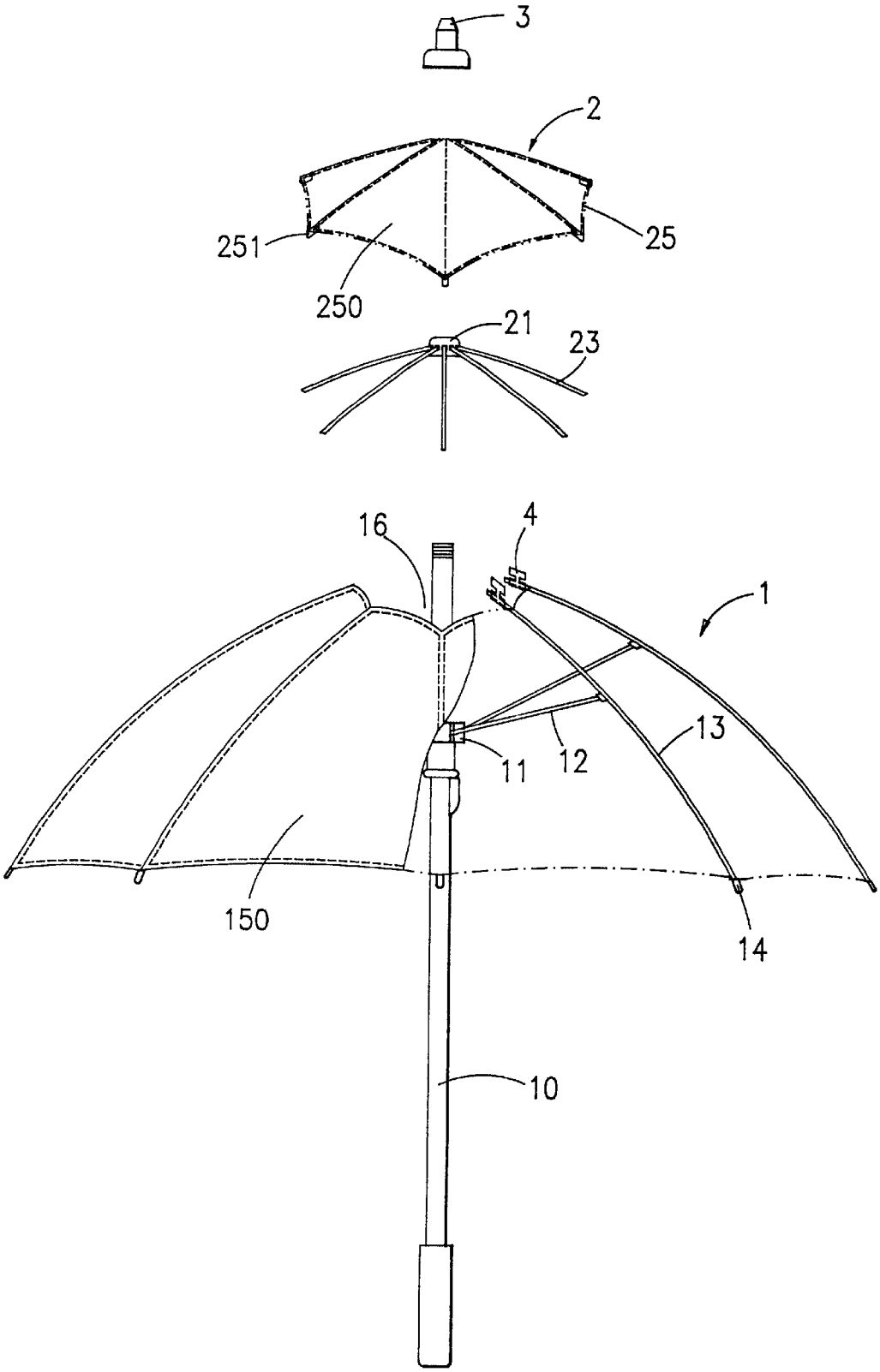
FIG. 5 is a partial exploded perspective view and a partial cross-sectional view of a windproof umbrella according to the present invention.
Figure 6:
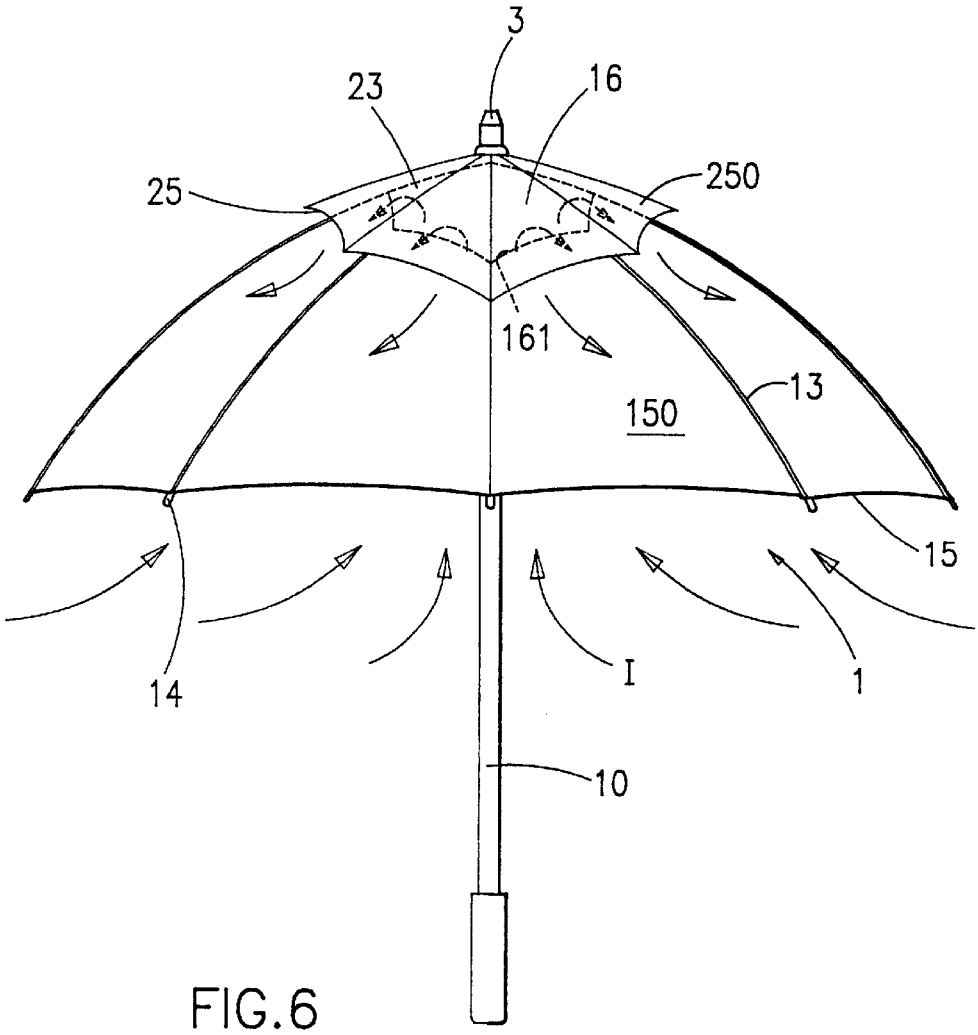
FIG. 6 is a perspective view of a windproof umbrella according to the present invention showing the wind is passing therethrough.

Referring to FIGS. 5 to 12, a windproof umbrella of the present invention includes a main umbrella 1, an upper umbrella 2 in covering relation to the main umbrella 1, and a ferrule 3 on a top of the upper umbrella 2. The main umbrella 1 comprises a shank 10, a ring 11 being capable of sliding along the shank 10, a plurality of ribs 13 each having a tip 14, a plurality of spreaders 12 each with one end pivotally secured to the ring 11 and the other end pivotally secured to a predetermined position of one of the ribs 13, and a lower canopy 15 having a plurality of (e.g., eight) generally trapezoidal cloth sectors 150 in which the seam between sectors 150 is stitched from the top to the bottom of each rib 13 along its length to the tip 14. A substantially polygonal (e.g., octagonal) vent hole 16 is provided in the center portion of the main umbrella 1.

The upper umbrella 2 comprises a stationary hub 21, a plurality of rigid ribs 23 each having a fixed end pivotally secured to the stationary hub 21, and an upper canopy 25 having a plurality of (e.g., eight) generally triangular cloth sectors 250 where a small cloth bag member 251 is provided to the outer perimeter of each sectors 250 and positioned thereunder. A free end of each of the ribs 23 is allowed to be received within the bag member 251 for being integral with the cloth sector 25 for forming a whole upper umbrella 2.

Figure 7:
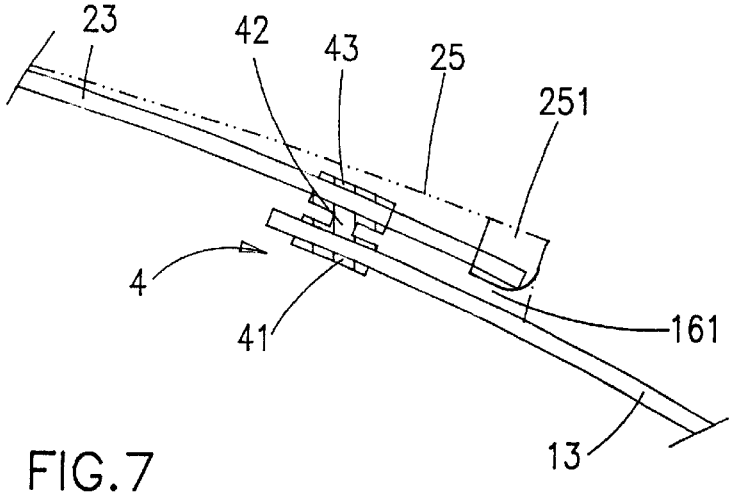
FIG. 7 is a cross-sectional view showing the connection of two main constituents of a windproof umbrella according to the present invention.
Figure 9:
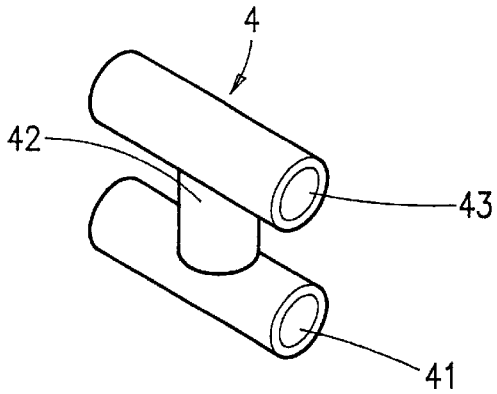
FIG. 9 is a perspective view of a securing device of FIG. 7.
Figure 10:
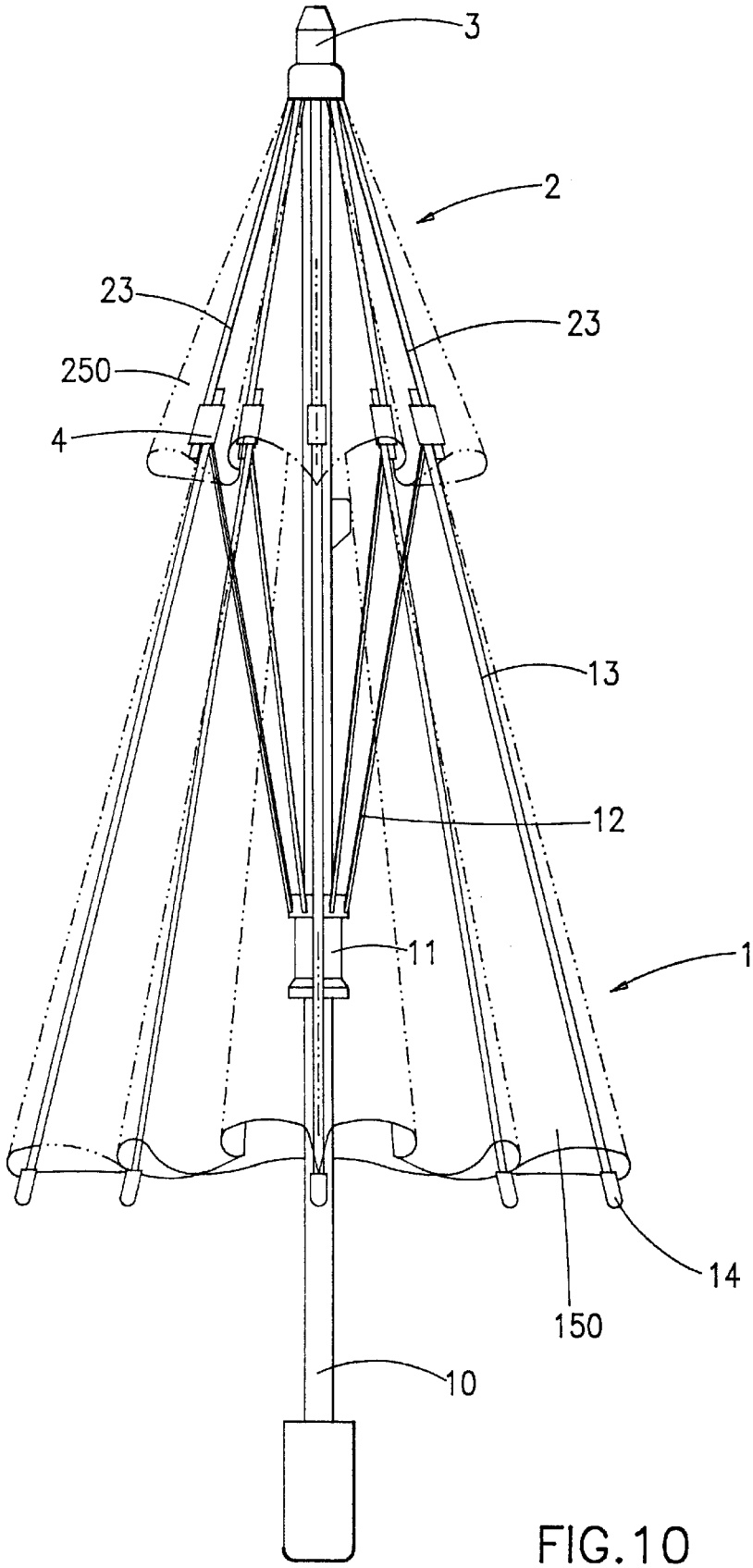
FIG. 10 is a perspective view of a windproof umbrella according to the present invention, in an assembled, closed condition.

As best shown in FIGS. 7 and 9, an I-shaped securing device 4 comprises a lower tube member 41, an upper tube member 43, and a rod member 42 for connecting the tube members 41 and 43.

Figure 8:
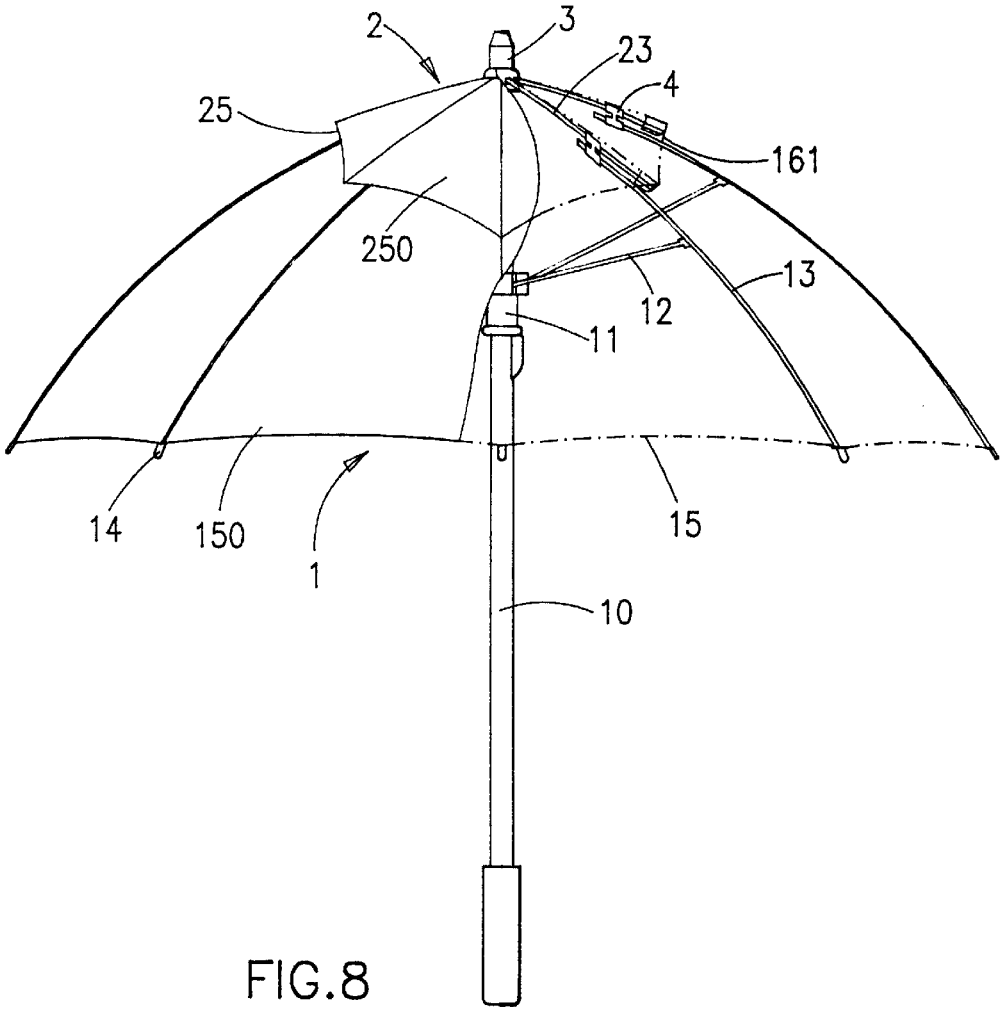
FIG. 8 is a perspective view of FIG. 6 in part section.

The assembly procedure of the windproof umbrella of the present invention is best shown in FIGS. 7 and 8. In assembly, first the cloth sectors 150 are stitched together to form the lower canopy 15 and then stitched from the top of each rib 13 along its length to the tip 14 for forming the main umbrella 1; second the cloth sectors 250 are stitched together to form the upper canopy 25; insert an upper end of each of the ribs 13 through the corresponding lower tube member 41 and the free end of each of the ribs 23 through the corresponding upper tube member 43 a predetermined distance such that the free end of the rib 23 will be received within the bag member 251; and finally, insert the ferrule 3 onto the stationary hub 21.

It is apparent that a plurality of gaps 161 exist between the upper canopy 25 and the lower canopy 15 due to the provision of the securing devices 4. As such, during windy weather, wind that is caught beneath the lower canopy 15 through the vent hole 16 and applies pressure to the upper canopy 25. This forces the upper canopy 25 lift away from the lower canopy 15 a predetermined distance (i.e., at least the height of the rod member 42) to provide a path through the gap 161 for the wind to escape the main umbrella 1.

Figure 11:
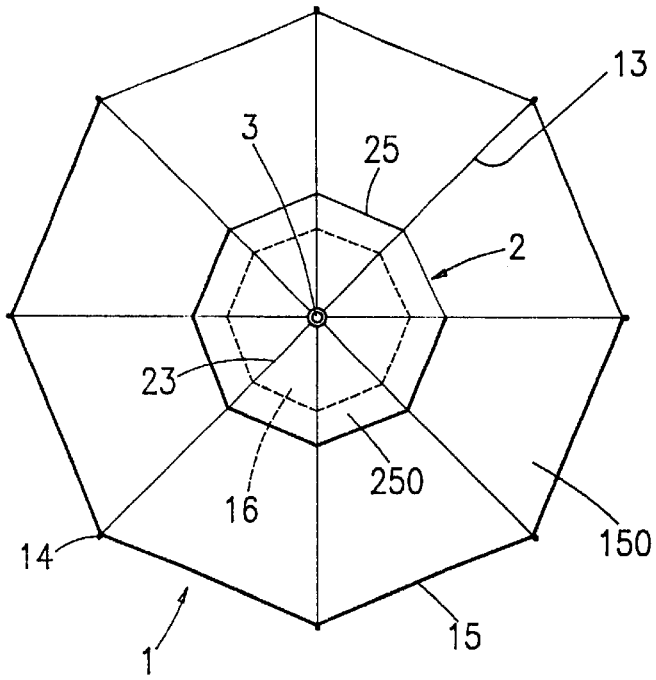
FIG. 11 is a top plan view of a windproof umbrella according to the present invention.
Figure 12:
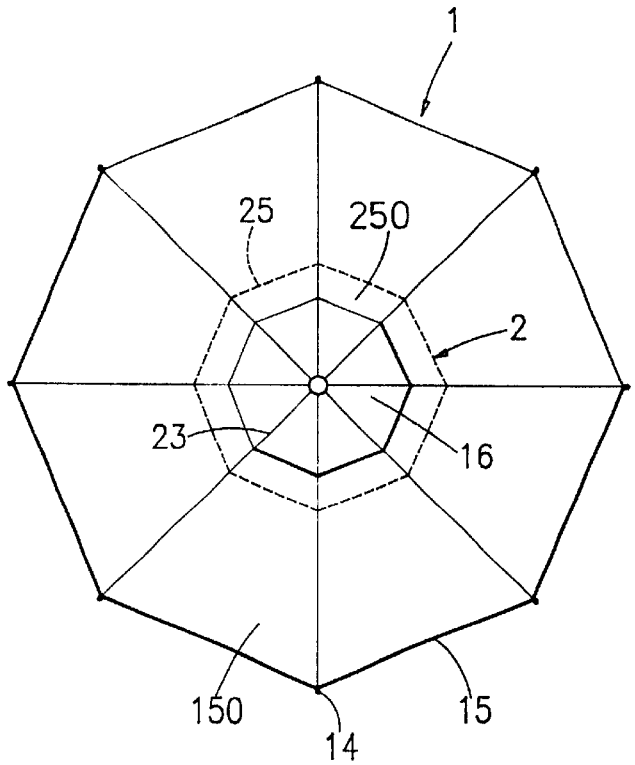
FIG. 12 is a bottom plan view of a windproof umbrella according to the present invention.

As best shown in FIGS. 11 and 12, the vent hole 16 is completely covered by the upper canopy 25, i.e., the upper canopy 25 extends to a distance beyond a perimeter of the vent hole 16. As such, during rainy weather, rain may not enter the gap 161 between each upper canopy sector 250 and each lower canopy sector 150 and fall through bottom edge of the vent hole 16 on the user.

ADVANTAGES OVER THE PRIOR ART

The invention is embodied without any elastic strip provided, and thus is durable. Further, the invention can preserve the umbrella's appearance by providing a relatively small upper umbrella over the relatively large main umbrella. Furthermore, the assembly of the invention is easy by eliminating the process of stitching the upper canopy to the ribs of the upper umbrella, and thus is cost effective. Above all, the invention can prevent the inversion of the umbrella while also preventing rain from falling on the user.

While the invention herein disclosed has been described by means of specific embodiments, numerous modifications and variations could be made thereto by those skilled in the art without departing from the scope of the invention set forth in the claims.

What is claimed is:

1. A windproof umbrella, comprising:

a main umbrella including a shank, a movable ring being capable of sliding along the shank, a plurality of ribs each having a fixed end portion and a free end portion, a plurality of spreaders each with one end pivotally secured to the ring and the other end pivotally secured to a predetermined position of one of the ribs, a lower canopy having a plurality of substantially trapezoidal cloth sectors in which a seam between sectors of the lower canopy is stitched from a top of each of the ribs along its length to the free end portion thereof, and a substantially polygonal vent hole provided in a center portion of the main umbrella;

an upper umbrella including a stationary hub, a plurality of ribs each having a fixed end portion pivotally secured to the stationary hub, and an upper canopy having a plurality of substantially triangular cloth sectors; and a ferrule on a top of the upper umbrella;

wherein the ribs of the upper umbrella are integral with the ribs of the main umbrella by means of a connection of an I-shaped member for forming a gap between a lower end of the upper umbrella and a perimeter of the vent hole of the main umbrella, the I-shaped member comprising a lower tube portion, an upper tube portion, and a rod portion for connecting the lower tube and upper tube portions, and the upper umbrella is in covering relation to and capable of elastically separating from the main umbrella.

* * * * *